United States Patent [19]

Luyckx

[11] 4,286,984

[45] Sep. 1, 1981

[54] COMPOSITIONS AND METHODS OF PRODUCTION OF ALLOY FOR TREATMENT OF LIQUID METALS

[76] Inventor: Leon A. Luyckx, 226 E. Hazelcroft Ave., New Castle, Pa. 16105

[21] Appl. No.: 136,885

[22] Filed: Apr. 3, 1980

[51] Int. Cl.[3] ..... C21C 7/02

[52] U.S. Cl. ..... 75/58; 75/53; 75/129; 75/134 A

[58] Field of Search ..... 75/53, 58, 27, 134 A, 75/129

[56] References Cited

U.S. PATENT DOCUMENTS 4,137,072 1/1979 Kawakami ..... 75/58

4,180,397 12/1979 Naylor ..... 75/58

*Primary Examiner*—P. D. Rosenberg

*Attorney, Agent, or Firm*—Buell, Blenko, Ziesenheim & Beck

[57] ABSTRACT

Compositions and methods of production are provided for treating liquid metals, such as desulfurizing, deoxidizing and otherwise purifying and controlling inclusion morphology, by injecting a particulate alloy with a neutral gas carrier below the surface of a molten metal, the alloy being free of silicon and carbon and consisting essentially of calcium, aluminum, iron and/or manganese, with magnesium, barium and alkali metals being present in amounts sufficient to provide desired characteristics associated with their presence.

13 Claims, No Drawings

COMPOSITIONS AND METHODS OF PRODUCTION OF ALLOY FOR TREATMENT OF LIQUID METALS

The present invention related to compositions and methods for production of an alloy for treatment of liquid metals and to the composition of an alloy additive for the treatment of liquid steel and other liquid metals and particularly to a silicon free calcium-aluminum-iron-manganese base alloy composition and methods of producing the same for the desulfurization of molten steel baths.

The injection of various materials into molten iron, steels and other liquid metals using a substantially non-reactive carrier gas has been practiced for many years and for a variety of purposes. Most recently the injection of materials into steel ladles has assumed large scale importance in the steel industry, particularly for the purpose of desulfurization of the molten steel in the ladle, and of control of the shape of the remaining sulfide and oxide inclusions in the wrought steel.

In general these prior art desulfurization practices have used calcium silicon alloys with about 65% silicon, calcium carbide with about 37.5% carbon, magnesium, magnesium aluminum alloys or mixtures of various lime based powder compositions. Each of these materials presents serious drawbacks in its use as a desulfurizing agent for injection. The lime base powder compositions which are available introduce excessive and undesirable amounts of hydrogen, cause substantial temperature losses in the molten metal and generally require excessive injection times. Magnesium and magnesium alloys, even when diluted at ratios of 5 to 1 with fluorspar or lime are extremely volatile at the temperatures of molten iron and steel. They either produce unacceptable splashing of metal and slag during injection or, if highly diluted, present the same problems as those of the lime-based powders discussed above. Calcium carbide, although very effective and economically attractive for steel desulfurization, is, as a practical matter, not usable in most circumstances because of the unacceptable carbon-pick up by the steel bath during injection. Finally, calcium-silicon, which has become by far the most popular in the steel industry for ladle injection, has serious shortcomings due to its high silicon content. Specifically, with the fast growing demand for extra low-sulfur, low-carbon, high manganese steels, a very strong economic incentive exists for using standard silico-manganese ferroalloy to provide a low cost source of low-carbon manganese units. However, the need to inject anywhere from three to ten pounds of calcium-silicon per ton of steel to desulfurize using the injection technique, introduces in many cases the entire silicon content allowed by the chemical specification for the particular grade of steel being poured. This directly conflicts with the use of low-carbon silico-manganese as the source of manganese values for the steel and forces the melter to turn to very high cost electrolytic or "massive" manganese. Thus, in the field of High Strength Low Alloy (HSLA) grades of steel for critical line pipe and plate applications, the use of calcium-silicon injection is undesirable.

Finally, the production of low carbon aluminum killed steel through the slab casting process, rather than by the conventional ingot casting route, has started to increase the demand for low sulfur steels to improve quality, and reduce tendency to cracking and segregation. These steels having a very low silicon specification, 0.02 or 0.03% maximum, the injection of calcium silicon is entirely out of the question and the alloy of my invention will perform the desulfurization and inclusion control function adequately.

I have invented a new alloy composition for liquid steel injection which is essentially free of silicon and carbon and consists essentially of calcium and aluminum with optional amounts of iron and manganese and minor amounts, up to 10%, of magnesium, barium and the alkali metals. Calcium and aluminum and at least one of the two elements iron and manganese, are essential to the alloy. Iron and/or manganese are/is added for alloying purposes, for reducing the volatility of the alloy, to improve its crushability or to make the alloy self decrepitating. Preferably I add sufficient iron and/or manganese to make the alloy readily crushable or to make it self decrepitating. The other elements are optional and may be added for some desired purpose or purposes. Broadly the alloy of my invention comprises:

Calcium—20% to 80%
Aluminum—5% to 50%
Iron and/or Manganese—5% to 60%
Magnesium—0 to 10%
Barium—0 to 10%
Alkali metals (Na,K,Li)—0 to 10%

A preferred range of composition is:

Calcium—20% to 80%
Aluminum—5% to 50%
Iron and/or Manganese—5% to 60%

A preferred narrow range is:

Calcium—30% to 70%
Aluminum—15% to 40%
Iron and/or Manganese—10% to 40%

The alloy of this invention is preferably reduced to at least 35 mesh and most preferably to minus 50 mesh powder and injected into the ladle, the tundish or the continuous casting mold with any of the conventional carrier gases presently being used and with any of the conventional or recently invented apparatus used for liquid metal injection.

The alloy of this invention may be made in several ways. At present two methods of manufacture appear to be most promising.

The first method of production consists in first melting a calcium aluminum eutectic alloy under a protective atmosphere and/or under a protective slag in a coreless induction furnace at 73% by weight of calcium and 27% aluminum on a highly basic refractory crucible of lime, magnesia or dolomite then adding increasing quantities of iron and/or manganese from 5 to 60% depending upon the desired level of dilution required to provide safe handling and to provide crushing and decrepitation characteristics.

The second method of production consists in melting a self-decrepitating Fe-Al or Mn-Al or Fe-Mn-Al alloy. The self-decrepitating range of composition for any of these alloys is about 40% to 60% Al with the optimum aluminum around 45% by weight. Calcium is then progressively added to the premelted alloy up to the desired level. Great care must be taken to dilute the calcium additions as quickly as possible and to protect them with a protective slag and/or atmosphere.

In the foregoing specification I have set out certain preferred practices and embodiments of my invention, however, it will be understood that this invention may be otherwise embodied within the scope of the following claims.

I claim:

1. An alloy essentially free from silicon and carbon for steel desulfurization and inclusion shape control consisting essentially of calcium and aluminum with iron, manganese, barium and alkali metals being present in amounts sufficient to provide desired characteristics associated with their presence, said aluminum being always present in at least a ratio by weight of Al:Ca=1:4, but not more than in a ratio of Al:Ca=1.5:1.

2. An alloy as claimed in claim 1 consisting essentially of:

Calcium—20% to 80% by weight,
Aluminum—5% to 50% by weight,
Iron and/or Manganese—5% to 60% by weight,
Barium—0 to 10% by weight,
Alkali Metals—0 to 10% by weight,
Magnesium—0 to 10% by weight.

3. An alloy as claimed in claim 1 consisting essentially of:

Calcium—20% to 80% by weight,
Aluminum—5% to 50% by weight,
Iron and/or Manganese—5% to 60% by weight.

4. An alloy as claimed in claim 1 consisting essentially of:

Calcium—30% to 70% by weight,
Aluminum—10% to 40% by weight,
Iron and/or Manganese—10% to 50% by weight.

5. The method of producing an addition alloy essentially free of silicon and carbon comprising the steps of:

(a) melting a calcium-aluminum alloy at a substantially eutectic composition in a coreless induction furnace on an ultra basic refractory lining and under at least one of a neutral atmosphere and a protective slag in proportions such that in the final product aluminum is always in at least a ratio by weight of Al:Ca=1:4, but not more than in a ratio of Al:Ca=1.5:1;
(b) adding to the molten calcium-aluminum eutectic up to 60% of a metal from the group consisting of iron and manganese; and
(c) cooling said alloy.

6. The method as claimed in claim 5 wherein the eutectic composition is about 73% Ca and 27% Al, by weight.

7. The method of producing an addition alloy essentially free of carbon and silicon comprising the steps of:

(a) melting an alloy of 40% to 60% aluminum by weight and the balance at least one metal from the group consisting of iron and manganese;
(b) progressively adding metallic calcium to said alloy until the calcium content is in the range 30% to 60% and the proportion of Al to Ca is such that in the final product aluminum is always in at least a ratio by weight of Al:Ca=1:4, but not more than in a ratio of Al:Ca=1.5:1; and
(c) solidifying said alloy.

8. A method of treating a molten bath of steel comprising injecting a particulate additive alloy having a size less than 35 mesh and consisting essentially of calcium and aluminum with iron, manganese, barium, alkali metals and magnesium being present in amounts sufficient to provide desired characteristics associated with their presence below the surface of said molten bath in a neutral carrier gas, the aluminum in said particulate additive alloy being always at least a ratio by weight of Al:Ca=1.4, but not more than a ratio of Al:Ca=1.5:1.

9. The method as claimed in claim 8 wherein the alloy is below 50 mesh in size.

10. The method as claimed in claim 8 or 9 wherein the alloy consists essentially of:

Calcium—20% to 80% by weight,
Aluminum—5% to 50% by weight,
Iron and/or Manganese—5% to 60% by weight.
Magnesium—0 to 10% by weight,
Barium—0 to 10% by weight,
Alkali Metals—0 to 10% by weight.

11. The method as claimed in claim 8 or 9 wherein the alloy consists essentially of:

Calcium—20% to 80% by weight,
Aluminum—5% to 50% by weight,
Iron and/or Manganese—5% to 60% by weight.

12. The method as claimed in claim 8 or 9 wherein the alloy consists essentially of:

Calcium—30% to 70% by weight,
Aluminum—15% to 40% by weight,
Iron and/or Manganese—10% to 40% by weight.

13. The method as claimed in claim 8 or 9 wherein the alloy is injected at a point adjacent the bottom of the molten bath.

* * * * *